US005443155A

United States Patent [19]

Robinson

[11] Patent Number: 5,443,155

[45] Date of Patent: Aug. 22, 1995

[54] WRIST RESTRAINING DEVICE

[76] Inventor: Edwin Robinson, 20 Crum Elbow Rd. 2-A, Hyde Park, N.Y. 12538

[21] Appl. No.: 266,725

[22] Filed: Jun. 27, 1994

[51] Int. Cl.[6] ..... B65D 85/00; E05B 75/00

[52] U.S. Cl. ..... 206/223; 24/16 PB; 70/16; 128/879

[58] Field of Search ..... 24/16 PB; 70/16; 128/878, 879; 206/223

[56] References Cited

U.S. PATENT DOCUMENTS

| | | | |
|---|---|---|---|
| 4,071,023 | 1/1978 | Gregory | 128/133 |
| 4,136,148 | 1/1979 | Joyce | 26/16 PB X |
| 4,854,138 | 8/1989 | Charland | 70/16 |
| 4,909,051 | 3/1990 | Lee | 70/16 |
| 4,910,831 | 3/1990 | Bingold | 24/16 PB |
| 4,964,419 | 10/1990 | Karriker | 128/879 |
| 5,088,158 | 2/1992 | Burkholder | 24/16 PB |
| 5,159,728 | 11/1992 | Bingold | 24/16 PB |
| 5,345,947 | 9/1994 | Fisher | 128/878 |

*Primary Examiner*—Jimmy G. Foster
*Attorney, Agent, or Firm*—George J. Brandt, Jr.; Thomas R. Morrison

[57] ABSTRACT

A wrist restraining device for restraining a person uses two strap element defined wrist enclosing loops and wherein strap lengths extend from the loops and are joined such as to define a U-shaped stiffened bight configuration with the bight facing a cinch bar used to tighten the loops. With tightening of the loops, the bight enlarges to a larger shaped configuration that serves as a handle locating distant from the person's restrained wrists and hands so that an officer can grasp the handle and use it as a control for controlling the person's movement without unnecessarily exposing the officer to the restrained person's hands. Structure to minimize pressure imposed on the person's wrists with the device is included in the device. A kit is provided for assembling the device from components representing the several elements of the device.

14 Claims, 3 Drawing Sheets

WRIST RESTRAINING DEVICE

BACKGROUND OF THE INVENTION

The present invention relates to a device for restraining a person's wrists and, more particularly, to a wrist restraining device which has two preformed loops thereby to facilitate most rapid insertion and tightened securement of the device on a person to be restrained, tightening of straps defining the loops resulting in lengthening of a strap part shaped in a bight configuration which can be employed as a device control handle for enhancing control over the person restrained.

Various types and constructions of flexible material wrist restraints for use by law enforcement personnel in dealing with subduing suspects and controlling prisoners are known. Such restraints in most instances are made of a polymeric based material and embody strap parts which can be formed into loops for girding both wrists of a person, and means to secure or lock the loops, the locking means commonly being teeth or projections carried on the strap parts and a cooperating latch or stop usually carried elsewhere on the strap parts for engaging the teeth or projections to effect a stop function which maintains the loops secured.

Representative of the mentioned constructions are U.S. Pat. Nos. 4,071,023; 4,909,05 1; 4,910,831; 5,088,158 and 5,159,728. These patents disclose using generally fiat strap parts as the loop forming component. U.S. Pat. No. 4,854,138 discloses using a flexible braid or rope-like element to form the ropes.

A limitation of certain of the representative constructions is that the strap formed loops while securable adequately around a person's wrists leave little or no part of the device extending in any significant manner from the loops where such conveniently, surely and safely could be used as a person control element by an officer moving the restrained person to a vehicle or wanting to put the person down on the ground. With these constructions, generally the officer must place his hands on the device proper and proximal those of the restrained person who could grab the officer and start a struggle. Where a part of the device extends from the loops, such is either inadequate from the point of good grabbing length or not suited to providing a secure hold.

U.S. Pat. No. 4,854,138 discloses a restraining device using a flexible braid to form loops which when tightened with a lock bar results in there being a length of the braid remaining which is said to provide a lead for leading the restrained person. This lead, however, is a flaccid, not easily held element that in a struggle likely can be pulled from an officer's hands. Further, the lead is of two side by side braid lengths which due to the nature of the material from which made and especially after making an overhand knot therein as taught in the patent, will almost always lay close to each other, and it would be problematical to rely on how quickly and effectively an officer could spread the two lengths to obtain a more firm grip than the simple grasping the two lengths together for effecting a control.

It also is to be noted with regard to the '138 patent device, that if a person whose wrists have been restrained with closely wrist fitting loops becomes unruly and further suppressive action thereby indicated, such could not be practiced by temporary imposition of additional loop tightening to produce person compliance since once a loop size is set with the device it cannot be altered to loosen what would be a significant continuous painful and circulation endangering loop tightness.

Accordingly, it is desirable that a wrist restraining device be provided which not only securely holds a person's wrists but also embodies a control handle safely and most effectively used to control the person once that person is in restraint.

OBJECTS AND SUMMARY OF THE INVENTION

Accordingly, it is an object of the invention to provide a wrist restraining device which overcomes the drawbacks of the prior art.

It is a further object of the invention to provide a wrist restraining device which additionally to securely restraining a person's two wrists, embodies a control handle feature to optimize control by a law enforcement officer over the person restrained.

It is a still further object of the invention to provide a wrist restraining device which can be inserted over a person's wrists and tightened with minimum delay there occurring concurrently with tightening, enlargement of a U-shaped stiffened bite formed in the device structure which serves as a person control handle with which an officer can control the person with minimum effort.

An additional object of the invention is to provide a wrist restraining device when the loops thereof are tightened closely conformably about a person's wrists, can be further tightened to reduce loop size in a suppression manipulation that causes discomfort to the person of a character which readily produces compliance but once such is established, the loops can enlarge to the original close conforming size to release the suppression tightening.

Another object of the invention is to provide a wrist restraining device which can be assembled from a kit containing components representing the several structural parts of the device.

Briefly stated, there is provided a wrist restraining device for restraining a person which uses two strap element defined wrist enclosing loops and wherein strap lengths extend from the loops and are joined such as to define a U-shaped stiffened bight configuration with the bight facing a cinch bar used to tighten the loops. With tightening of the loops, the bight enlarges to a larger shaped configuration that serves as a handle locating distant from the person's restrained wrists and hands so that an officer can grasp the handle and use it as a control for controlling the person's movement without unnecessary exposure of the officer to the restrained person's hands. Structure to minimize pressure imposed on the person's wrists with the device is included in the device, and a kit can be provided for assembling the device from components representing the several elements of the device.

In accordance with these and other objects of the invention, there is provided a device for restraining a person's wrists, the device comprising first and second elongated strap parts folded into respective first and second wrist receptive enlarged loop configurations with a first tip end of each of said strap parts passing slidably through a slotted enlargement in its associated strap part which slotted enlargement defines a second opposite strap part end location. The strap part tip ends and following strap part lengths extend a distance beyond the loop configurations with the tip ends being connected together so as to present with said following strap part lengths a stiffened U-shaped strap bight. Spacer means extend between the first and second loop configurations for holding the loop configurations spaced a distance apart, said spacer means being freely slidably movable on the loop configurations. An elongated cinch bar has opposite ends in which the following strap part lengths are received in pass through relation, the cinch bar being proximal and the spacer means remote the strap bight. Cooperating detenting means are carried on the cinch bar opposite ends and on the strap parts, this detenting means being operable to allow loop configuration reduction from enlarged to reduced size wherein closely conforming loop embrace of the person's wrists exists be effected. This loop configuration reduction can by effected either by sliding the cinch bar on the strap part following lengths in one direction while said strap part following lengths are held or by sliding the strap part following lengths in an opposite direction while the cinch bar is held. The detenting means also is operable further to prevent loop configuration enlargement by either locking the cinch bar in stopped position on the strap parts when a force tending to slide the cinch bar counter to said one direction is imposed on the cinch bar or locking the strap part following lengths in stopped position in the cinch bar when force is imposed on said strap part following lengths tending to slide them counter to said opposite direction.

In accordance with the invention, loop defining strap pieces can be separate pieces associated each with one of the two loops and in which instance, a separate spacer element for spacing the loops a fixed distance apart will be provided.

Alternatively, the loop defining strap parts can be fixed at ends of each to a spacer element.

Further in accordance with the invention, one or more kits containing components with which the restraining device can be field or pre need assembled are provided.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
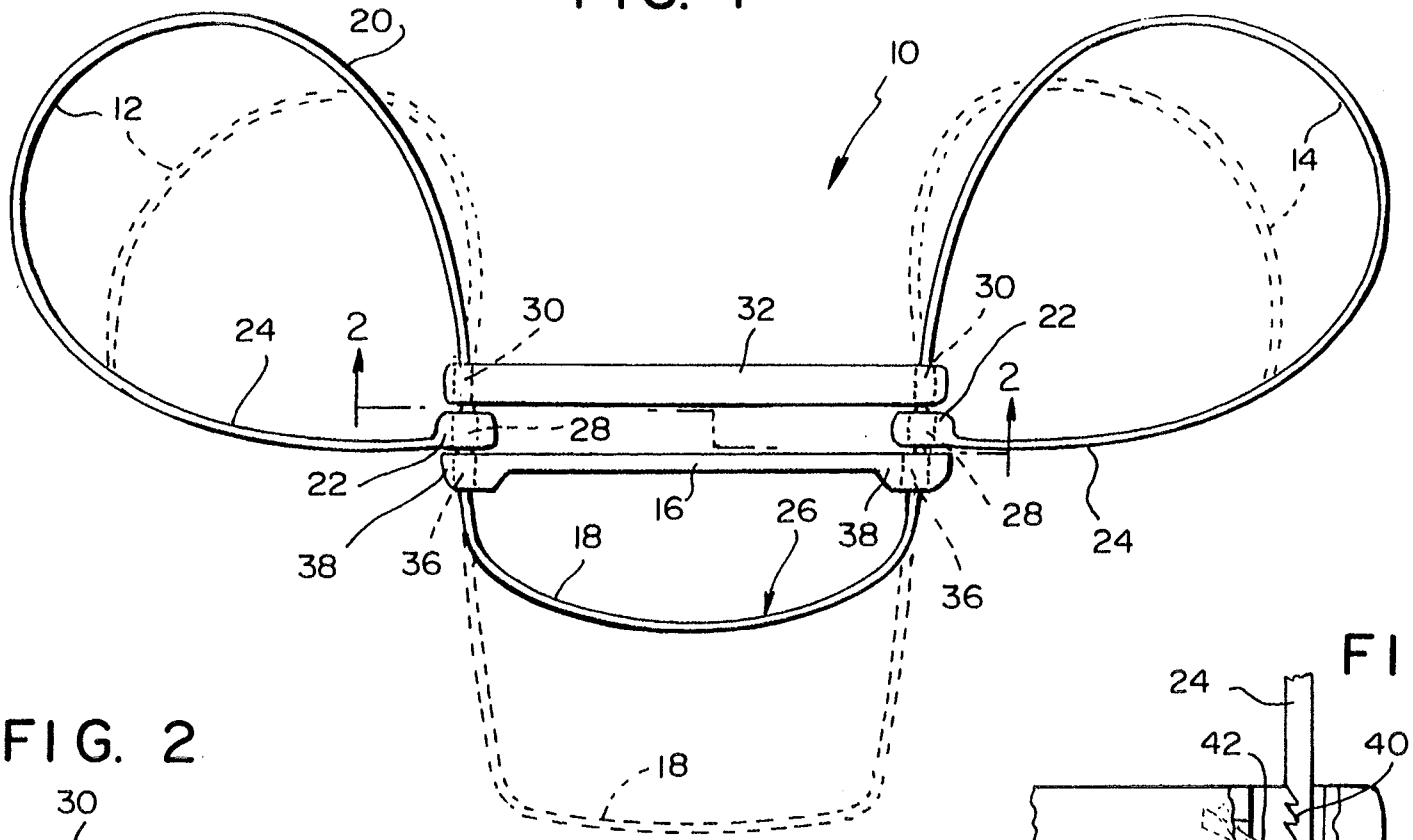
FIG. 1 is a top plan view of an embodiment of the restraint device constructed in accordance with the principles of the present invention.

FIG. 1 depicts an embodiment of the restraining device 10 of the invention as it is configured in condition ready for use by a law enforcement officer when needed at the time of subduing and/or taking control of a crime suspect or person being taken into police custody. The two loops 12, 14 of the device are received over the person's wrists and the cinch bar 16 is slid on the strap from which the loops are configured (in upward direction in the Figure), and this tightens the loops conformably about the wrists and at the same time a U-shaped, stiflened bight including handle 18 enlarges. The person's hands and wrists are now effectively immobilized and further control of the person by use of the handle 18 enables the officer to render the person placid and subject to physical placement such as downing of the person to the ground to assure countering of any meaningful retaliatory action by the person.

The thus noted procedure requires reduced involvement of the officer with the person as the securement of the restraint is quick and securement concurrently provides handle control capability immediately.

Figure 3:
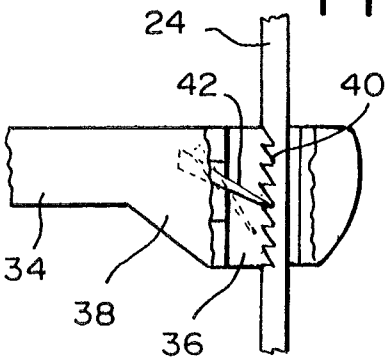
FIG. 3 is a fragmentary plan view on enlarged scale with portions broken away showing the manner in which pawls or a like stop element in the cinch bar ends function with strap carried teeth to prevent cinch bar movement in a direction that would result in loop enlargement.
Figure 2:
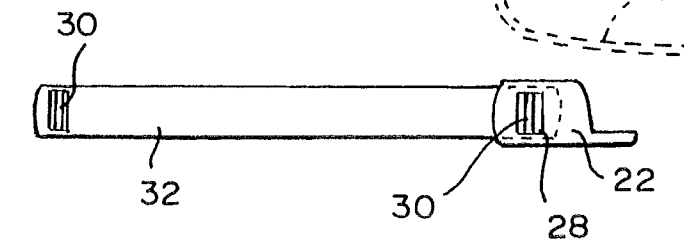
FIG. 2 is a vertical sectional view taken on the line II—II in FIG. 1.

Referring again to FIG. 1 and to FIG. 3, the device 10 is comprised as an elongated strap 20 (which as will be detailed later is made up from two separate strap pieces), opposite ends of the strap 20 being configured with enlarged tip end pieces 22, these tip end pieces being of rounded, smooth contour and devoid of any protuberant structure which when the wrist restraint is employed serves to prevent harmful constriction of blood circulation in the restrained person's wrists held in close embrace with the device or occurrence of other undesirable injury to the person.

The strap is configured to include loops 14, 16 which are defined by the folding of terminal length parts 24 of the strap adjacent the tip end pieces 22 into loop defining courses with the tip end pieces slidably received on a strap central length part shown generally at 26, it being understood that this central length part will have a somewhat shortened length with the device and loops thereof in the FIG. 1 solid line depiction but that when the loops are reduced to a restraining size about a person's wrists, the strap central length part will increase, this being shown in dashed lines in FIG. 1. The tip end pieces 22 have through slots 28 therein for strap pass through.

The loop defining straps also pass through slots 30 formed in the opposite ends of a rigid relatively strong spacer piece 32, this spacer piece serving to maintain the loops and hence person's wrists held therein spaced apart, the spacer piece being freely slidable on the straps. The spacer piece 32 as can be seen is disposed at a common side of the tip end pieces 22.

A cinch bar 34 has its opposite ends slotted as at 36 so it can thereby be received in strap pass through relation on the strap central length part, the cinch bar being disposed at the opposite sides of the tip end pieces 22. The opposite cinch bar ends can be enlarged with bosses as at 38. The cinch bar 34 is employed to swiftly and with minimum manipulation tighten the loops 14, 16 closely around a person's wrists following placement of the person's hands through the loop openings.

As with certain known constructions, detenting of the straps following loop tightening is effected in manner as to admit of cinch bar sliding in a loop tightening direction but to prevent cinch bar movement in an opposite direction. This detenting is accomplished with teeth 40 carried on the strap central length part and on the at least a portion of the strap terminal length parts and as can be understood with reference to FIG. 3 and, additionally, a stop element such as a pawl 42 carried in the bosses of the cinch bar. The teeth 40 are carried on the loop outer side face of the strap terminal length parts which corresponds to the inner face side of the strap central length part. The pawl 42 set in the boss 38 is a flexibly, yieldably mounted element and projects into the cinch bar slot 36. When a strap part is drawn through the slot 36 in tightening direction, pawl 42 will deflect to the dashed line position and allow unimpeded strap travel in one direction. On the other hand, the pawl tip end will engage securely in a tooth 40 if force be imposed on the strap part as would tend to move it in an opposite direction, e.g., a restrained person's effort to loosen the held bond of his wrists.

With reference again to FIG. 1, it is seen that the strap central length part 26 is due to the characteristics of the polymeric material from which the device is made, and the geometry and length of the cinch bar caused to assume a configuration of a stiffened U-shaped bight facing the cinch bar. This bight, as expressed earlier, defines a control handle extending some distance away from the tightened loop encirclement of the restrained person's hands and enables a police officer to exercise control over the person with the control handle to readily and safely control exertion of the restrained person or employ compliance action therewith such as pulling the person to ground all without facing exposure to untoward struggling by the person.

Enlargement of the scope of the control handle structure attends tightening of the restraining loops as is seen in FIG. 1 where the expanded scope of the control handle is evident in the dashed line showing.

The device 10 as indicated above most conveniently involves using two separate strap pieces to form the elongated strap. This enables assembly of the device in simplest fashion. However, the two straps leave length runs which must be joined to provide the strap central length part. In one manner, this can be done by overlapping these length runs in modest length and then subjecting the overlapped runs to application of heat and pressure to effect coalescence bonding of same into a single mass of substantially the same width and thickness of the base strap pieces. The resultant bonding effect is seen at the bond line 50 in FIG. 1, the bonding being the agency which provides the U-shaped bight.

Figure 4:
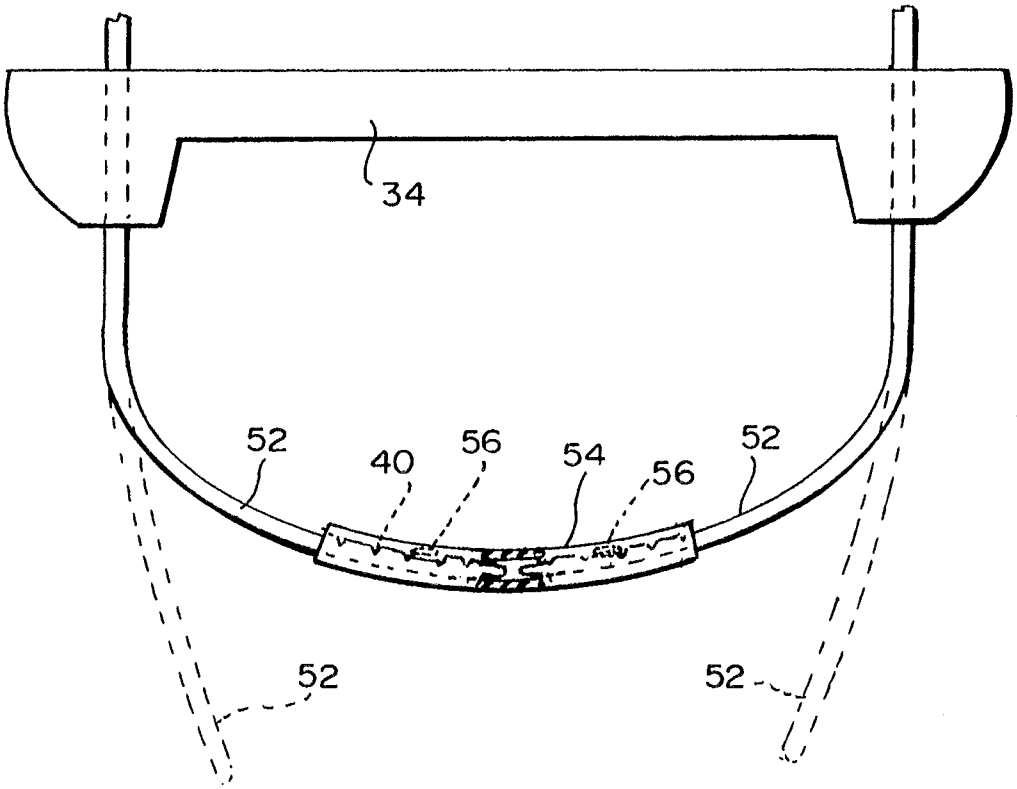
FIG. 4 is a fragmentary plan view on enlarged scale depicting one manner of forming the strap central length part by joining strap free end parts with a lock connector and handle piece with parts broken away for purpose of clarity of depiction.

Other manners of effecting connection of the length runs can be used and one such way is depicted in FIG. 4. In such, the length runs 52 of the strap pieces (shown in dashed lines) are joined together in mechanical connection by use of a connector handle 54 provided as a tubular member in which the end portions of the length runs can be received insertably in non removable fashion. The teeth 40 on the end portions are engaged by stop pawls 56 carried on the inside of the tubular member. These pawls function in the same way as those previously described in connection with the detent locking of the loop defining strap parts. Once received in the tubular member, the end portions cannot be withdrawn. The tubular member 54 will in one form have an arcuate longitudinal side profile, although other profile possibilities also can be used. The tubular member enhances the handle character and assures the retention of U-shaped and stiffened bight configuration, the assembled result being shown in solid lines in FIG. 4.

Figure 6:
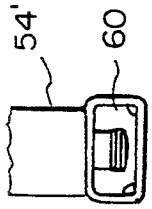
FIG. 6 is a fragmentary end view of the lock connector and handle piece shown in FIG. 5.
Figure 5:
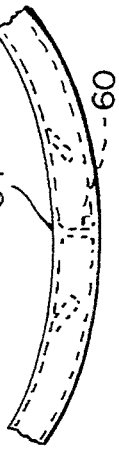
FIG. 5 is a side elevational view of a modified form of the lock connector and handle piece.

FIGS. 5 and 6 shown a modified connector handle 54' which is like that above described except additionally, it has an interior stop abutment or wall 60 which serves to limit or stop the extent of entry of the strap length runs 52 into the connector handle.

An advantage of the device of the invention is the convenience its construction allows for utilization of a kit containing components needed to assemble restraint devices with control handle adjunct as needed or in advance of anticipated need as where disturbances are in the making and expectation of requirement for taking custody of numbers of persons is foreseen. Actual assembly of devices generally will not be at site of the event but rather facility for providing assembly of devices is the purpose as the need can be met at a station house in advance of the response where need is found.

Figure 9:
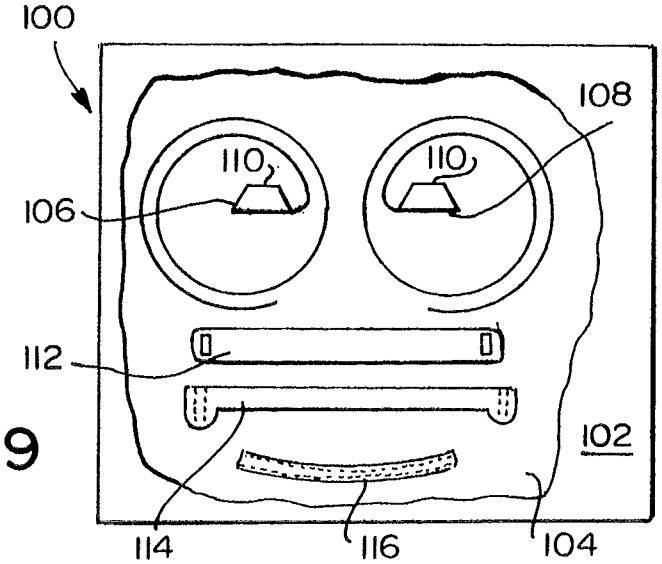
FIG. 9 is a plan view of a FIG. 1 embodiment kit.

Such a kit 100 is shown in FIG. 9. The kit is such that plural ones thereof could be kept in a squad car, station or even on the person of a police officer and thus, readily be available as demand dictates.

Kit 100 includes an envelope 102 of, e.g., flexible material in which is confined the components required for assembling a device, e.g., on a base or board 104 there will be found a pair of straps 106, 108, these straps having at one tip end 110 a slotted opening. Also included will be a spacer bar 112 slotted at its opposite ends, and a cinch bar 114 which will be slotted at its opposite ends. It will include a handle piece 116 of tubular character.

In assembling a device from the kit components, each of the straps 106, 108 will be folded such as to form a loop and a leading strap end will be passed successively through an end slot of a spacer bar, the slot in the enlarged tip end of the strap itself, and an end slot in the cinch bar. A strap running length distal the loop made therewith will then be inserted in an end of the tubular member. This will produce the device seen, for example in FIG. 1 and 4 ready for use for its intended purpose.

Figure 7:
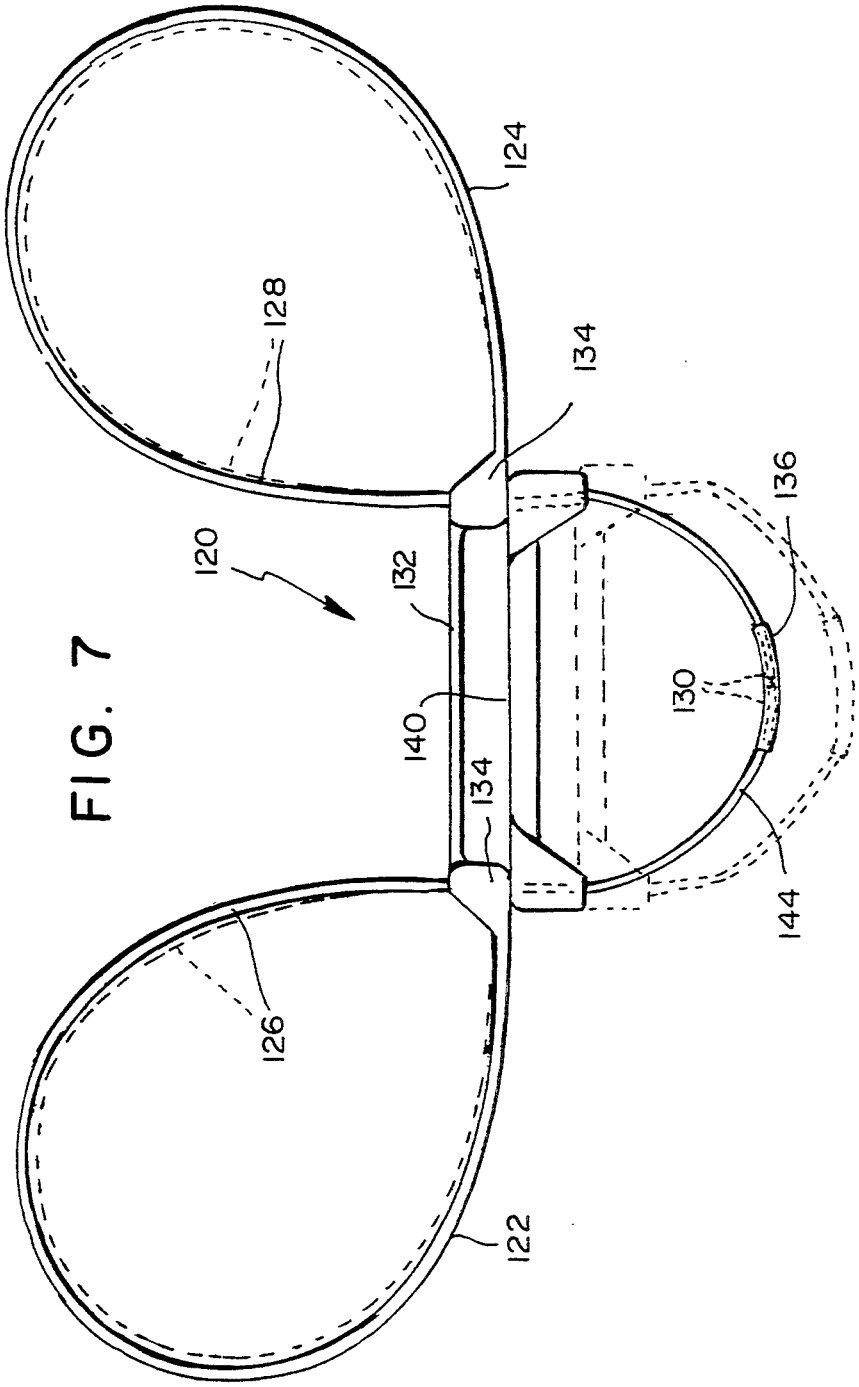
FIG. 7 is a top plan view of another and preferred embodiment of the restraint device.

FIG. 7 shows another and preferred embodiment 120 of restraint device which comprises first and second flexibly structured strap parts 122, 124 which can be folded into respective first and second wrist receptive loop configurations 126, 128. The strap parts 122, 124 have tip ends as at 130, and the strap parts are fixed to a rigid spacer element 132, the strap parts having slotted enlargements 134 defining strap part second opposite strap part end locations.

The tip ends 130 of the strap parts are connected together by receiving them in a connector handle 136 so that a stiffened U-shaped bite 144 is produced. A cinch bar 140 like that earlier described in connection with FIG. 1 also is provided. In connection with the cinch bar and its functioning, it is to be noted that the same earlier described cooperating detent means earlier described are carried therein and on the strap parts and operates to allow loop configuration reduction from enlarged to reduced size wherein the loops closely embrace a persons wrists either of the actions given next.

The cinch bar can be slid on the strap part following lengths in one direction while the strap part following lengths are held. Alternately, the strap part lengths are slid in an opposite direction while the cinch bar is held. The detent means are such that loop configuration enlargement, as by the restrained persons efforts to force such, is prevented because same stops the cinch bar in stopped position when a force tending to slide it counter to the said one direction is imposed thereon or it locks the strap part following lengths in the cinch bar if force is imposed on the strap part following lengths tending to slide them counter to said opposite direction.

The construction and functioning of both the FIGS. 1 and 7 embodiments of the device provides person a superior temporary suppression capability to the device not possible with or found in analogous prior art devices. This capability is described briefly and with reference to FIG. 7. In that Figure the loop configurations are shown in solid lines when such loops are in close conforming embrace about a persons wrists the person having been subdued and restrained. If the person starts to act up, an arresting officer can simply by pulling on the bight 144 (downward direction in FIG. 7) apply a temporary intense and highly discomforting further constricting diminished loop size to the device. The effect produced in the person is to render him most compliant and almost always cease his struggle with the officer.

The temporary further constriction is possible because pulling on the bight 144 results in the bight and cinch bar moving in unison due to the way the detenting means functions. The movement need only be slightly as shown in dashed lines. That the loops reduce is assured because the enlargements 134 and stiffness of the strap material cause only the strap parts to move slidably through the enlargements while the enlargements remain essentially static. When the pull on the bight is relaxed, the loops will slightly expand to the originally tightened closely wrist conforming size. Such is not possible with prior art devices because to further reduce loop size requires using the cinch means and once the cinch means of such devices is moved to a given locked condition it cannot be released.

Figure 8:
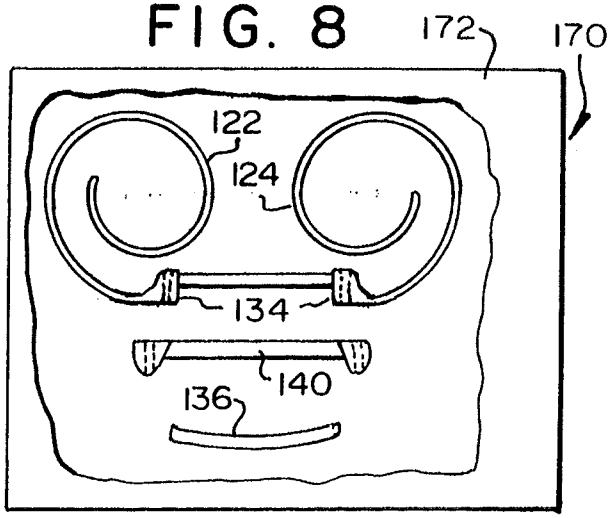
FIG. 8 is a plan view of a kit containing components with which a wrist restraining device of the FIG. 7 embodiment of the invention can be assembled.

FIG. 8 depicts a kit 170 with which the FIG. 7 device 120 can be field or pre assembled. The components 122, 124, 134, 136 and 140 are enclosed in a package 172.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A device for restraining a person's wrists, said device comprising first and second elongated flexibly structured strap parts folded into respective first and second wrist receptive enlarged loop configurations with a first tip end of each of said strap parts passing slidably through a slotted enlargement in its associated strap part which slotted enlargement defines a second opposite strap part end location, the strap part tip ends and following strap part lengths extending a distance beyond the loop configurations with the tip ends being connected together so as to present with said following strap part lengths a stiffened U-shaped strap bight, spacer means extending between the first and second loop configurations for holding said loop configurations spaced a distance apart, an elongated cinch bar having opposite ends in which the following strap part lengths are received in pass through relation, the cinch bar being proximal and the spacer means remote the strap bight, cooperating detenting means carried on said cinch bar opposite ends and on said strap parts, said detenting means being operable to allow loop configuration reduction from enlarged to reduced size wherein closely conforming loop embrace of the person's wrists exists be effected by either sliding the cinch bar on the strap part following lengths in one direction while said strap part following lengths are held or by sliding the strap part following lengths in an opposite direction while the cinch bar is held, said detenting means being operable further to prevent loop configuration enlargement by either locking the cinch bar in stopped position on the strap parts when a force tending to slide the cinch bar counter to said one direction is imposed on the cinch bar or locking the strap part following lengths in stopped position in the cinch bar when force is imposed on said strap part following lengths tending to slide them counter to said opposite direction.

2. A wrist restraining device in accordance with claim 1 in which the spacer means comprises an elongated relatively rigid element having slotted openings at opposite ends thereof, the folded strap parts passing through the said opposite end slotted openings, the spacer element being disposed at a common side of the strap parts slotted enlargements, the cinch bar being disposed at an opposite common side of said strap parts slotted enlargements.

3. A wrist restraining device in accordance with claim 2 in which the strap parts slotted enlargements and the opposite ends of the spacer element comprise smooth surfaced structure devoid of protuberances.

4. A wrist restraining device in accordance with claim 1 in which the spacer means comprises an elongated relatively rigid element fixed at opposite ends thereof to the strap parts slotted enlargements.

5. A wrist restraining device in accordance with claim 4 in which the spacer element opposite ends are fixed to the strap parts slotted enlargements as structure integral therewith.

6. A wrist restraining device in accordance with claim 1 in which the strap part tip ends are connected together in a bonded joinder thereof.

7. A wrist restraining device in accordance with claim 6 in which the strap parts are of a polymeric material, the bonded joinder being one in which the tip ends and strap part lengths adjacent such tip ends have been overlapped and subjected to heat and pressure application to effect bonding together thereof.

8. A wrist restraining device in accordance with claim 1 in which the strap parts tip ends are connected together by reception of each in a connector handle piece, the said tip ends and said handle piece embodying companion connector locking means to lock the received tip ends non-removably in said connector handle piece.

9. A wrist restraining device in accordance with claim 8 in which said handle connector piece is a tubular component in which the strap parts tip ends are insertable, the locking means comprising pawls carried in the tubular component and teeth carried on the said tip ends, the pawls yieldably deflecting away from the teeth on the said strap parts tip ends when said tip ends are inserted in the tubular component but non yieldably engaging the teeth if slide force be imposed on said tip ends to withdraw them from the tubular component.

10. A wrist restraining device in accordance with claim 9 in which said tubular component is arcuate in longitudinal side profile.

11. A wrist restraining device in accordance with claim 1 in which the detenting means comprises teeth carried on the strap parts and pawls carried in the cinch bar ends, the pawls engaging the teeth in a stopping relationship therewith when either a force tending to slide the cinch bar counter to said one direction is imposed on the cinch bar or a force tending to slide the strap part following lengths counter to said opposite direction is imposed on said strap part following lengths.

12. A kit of components for assembling a twin loop restraining device for use in restraining a person's wrists and embodying a control handle adjunct, the kit comprising the combination of a pair of elongated, flat flexibly structured straps, one end of each of said straps having an enlarged tip end with there being a slot in such tip end, there being teeth carried at one flat side face of each strap and extending an appreciable length along such one flat side face from an opposite strap end toward the enlarged tip end, an elongated, relatively rigid spacer piece, there being slots in each of opposite ends of the spacer piece, an elongated cinch bar, the cinch bar having pass through slots at opposite ends thereof, there being a stopping means embodied at each cinch bar end, each said strap being foldable into a loop configuration with its said opposite strap end making pass through successively of one of the end slots of the spacer bar, the slot in the enlarged tip end of said strap and one of the cinch bar opposite end slots, the stopping means in each cinch bar end being operable to allow pass through of the said strap in one direction but to engage the teeth on the strap flat face if withdrawal movement force be imposed on the strap in an opposite direction, each said strap being of length sufficient to produce an enlarged loop course therewith and to provide a length run thereof located beyond the cinch bar distal the loop course, a connector handle comprising a tubular member, the length run of each strap distal its associated loop course being insertable into an end of said tubular member so that with the length run of each strap received in the tubular member, such length runs and the tubular member constitute a U-shaped stiflened bight facing the cinch bar and constituting a device control handle, the cinch bar being slidable on each strap to reduce the size of the loops to close conforming embrace of a person's wrists which have been received therethrough and therewith correspondingly enlarging the length runs of each strap provide an enlarged bight size, the tubular member having strap teeth engaging lock means operable to engage the teeth of strap length runs inserted therein and prevent removal of said strap length runs from the tubular member, and an envelope enclosing the components aforesaid.

13. The kit of claim 12 in which the tubular member has an arcuate longitudinal side profile.

14. A kit of components for assembling a twin loop restraining device for use in restraining a person's wrists and embodying a control handle adjunct, the kit comprising the combination of a strap unit including first and second elongated strap parts joined to a central spacer element, the strap parts at joinder to the spacer element having slotted enlargements, the first and second strap parts being foldable into respective first and second wrist receptive enlarged loop configurations when a tip end of said respective strap parts is passed through the strap part associated slotted enlargement with such tip end and a following strap part length extended a distance beyond an associated loop configuration, an elongated cinch bar positionable distal the loop configurations and having opposite ends in which the following strap part lengths of the respective strap parts are receivable in pass through relation, a connector handle comprising a tubular member in which the tip ends and at least some of the following strap part lengths of the strap parts are receivable so that such following strap part lengths and the connector handle define a U-shaped stiflened bight facing the cinch bar and constitute a device control handle, the cinch bar and the strap parts having cooperating detent means operable to permit sliding of the cinch bar on the strap parts or pull through of the following strap part lengths in the cinch bar to reduce the size of the loop configurations to close conforming embrace of a person's wrists which have been received therethrough, the detent means being operable to prevent an opposite cinch bar sliding or pull through of the following strap part lengths in the cinch bar thereby to prevent enlargement of the loop configurations from reduced to enlarged size, and a envelope enclosing the components aforesaid.

* * * * *